United States Patent [19]

Wsyzynski

[11] Patent Number: 4,880,197

[45] Date of Patent: Nov. 14, 1989

[54] MOUNTING MEANS FOR A TOY MOBILE

[75] Inventor: Randall Wsyzynski, West Seneca, N.Y.

[73] Assignee: The Quaker Oats Company, Chicago, Ill.

[21] Appl. No.: 259,476

[22] Filed: Oct. 17, 1988

Related U.S. Application Data

[63] Continuation of Ser. No. 101,988, Sep. 29, 1987, abandoned.

[51] Int. Cl.[4] ..... F16M 13/00

[52] U.S. Cl. ..... 248/324; 248/610; 446/227

[58] Field of Search ..... 248/324, 317, 328, 330.1, 248/610–613, 589, 215, 163.1; 446/227; 267/74, 73; 273/85

[56] References Cited

U.S. PATENT DOCUMENTS

| | | | |
|---|---|---|---|
| 308,256 | 11/1884 | Hayward | 267/74 X |
| 442,629 | 12/1896 | Cipscomb | 446/227 X |
| 1,281,128 | 10/1918 | Boren | 248/573 X |
| 1,690,957 | 11/1928 | Tommins | 267/74 |
| 2,593,940 | 4/1952 | Van Meter | 267/74 X |
| 2,769,276 | 11/1956 | Steiner | 446/227 |
| 2,994,156 | 8/1961 | Steiner et al. | 446/227 |
| 3,290,817 | 12/1966 | Kravath | 446/227 |
| 4,138,104 | 2/1979 | D'Amicis | 272/85 |
| 4,391,064 | 7/1983 | Lakin et al. | 446/227 |
| 4,417,725 | 11/1983 | Van Horn | 272/85 |

FOREIGN PATENT DOCUMENTS

| | | | |
|---|---|---|---|
| 155451 | 9/1938 | Fed. Rep. of Germany | 248/610 |
| 893564 | 8/1944 | France | 267/74 |
| 80240 | 3/1934 | Sweden | 248/610 |

*Primary Examiner*—Alvin C. Chin-Shue
*Attorney, Agent, or Firm*—Cumpston & Shaw

[57] ABSTRACT

A toy mobile is disclosed having an improved mounting mechanism in which the mobile freely hangs vertically without requiring a mounting arm of the mounting mechanism to be positioned in a specific orientation. The toy mobile further has a spring connector to allow vertical movement of the mobile relative to the mounting mechanism, and stop surfaces on the mobile to limit the vertical movement to a finite distance. To allow rotatable movement of the mobile, the spring is coupled to the mobile by a string secured to a bead and chain connector. The bead and chain connector functions as a slip clutch to prevent the string from overwinding and breaking.

3 Claims, 3 Drawing Sheets

MOUNTING MEANS FOR A TOY MOBILE

This is a continuation of co-pending application Ser. No. 101,988 filed on Sept. 29, 1987 now abandoned.

FIELD OF THE INVENTION

The present invention relates generally to toys, and more specifically to a mounting means for a toy mobile that is mountable on a support surface, such as a crib or the like.

BACKGROUND OF THE INVENTION

Toy mobiles of the type that are mountable by mounting means on cribs, playpens or other sturdy support surfaces, are well known in the art. The mobiles are normally formed of attractive characters such as animals, birds, butterflies or the like, and in some instances, the mounted mobile is rotatably motor driven and accompanied by music. A need still exists, however, for improved mounting means for toy mobiles that allow reliable rotation of the mobile without the need of expensive motors or the like, are capable of withstanding pulling and rough treatment by infants without breakage, and allow the toy mobile to freely hang vertically even though the orientation of the mounting means is changed.

Therefore, an object of the present invention is to provide an improved mounting means for a toy mobile that is of simple design and construction, that can withstand rough handling by an infant without suffering extensive damage, that will reliably support the mobile in a vertical orientation in different positions of orientation of the mounting means, that will allow free rotation of the mobile without damaging the mounting means, and that is inexpensive and economical to manufacture.

SUMMARY OF THE INVENTION

It is an object of this invention to provide mounting means for a toy mobile comprising:

a mounting arm having one end securable to a support and an opposite free end adapted to be arranged in a selected orientation;

a movable mobile; and means for coupling the free end of the mounting arm to the mobile for allowing the mobile to hang vertically even though the free end of the mounting arm deviates from its selected orientation.

Another object of the invention is accomplished by providing mounting means in which a mounting arm thereof has a cylindrical portion for captively supporting an eyelet member that is connected to the mobile.

Still another object of the invention is accomplished by providing the coupling means between the mobile and mounting arm with a spring and stop shoulders to limit extension and contraction of the spring.

Still another object of the invention is accomplished by providing a string between the mobile and spring of the coupling means, and at least one bead and chain connector connected to the string to function as a slip clutch to allow unlimited rotation of the mobile in either direction without overwinding and breaking the string.

BRIEF DESCRIPTION OF THE DRAWINGS

In the detailed description of the invention presented below, reference is made to the accompanying drawings, in which.

DETAILED DESCRIPTION OF THE INVENTION

Figure 1:
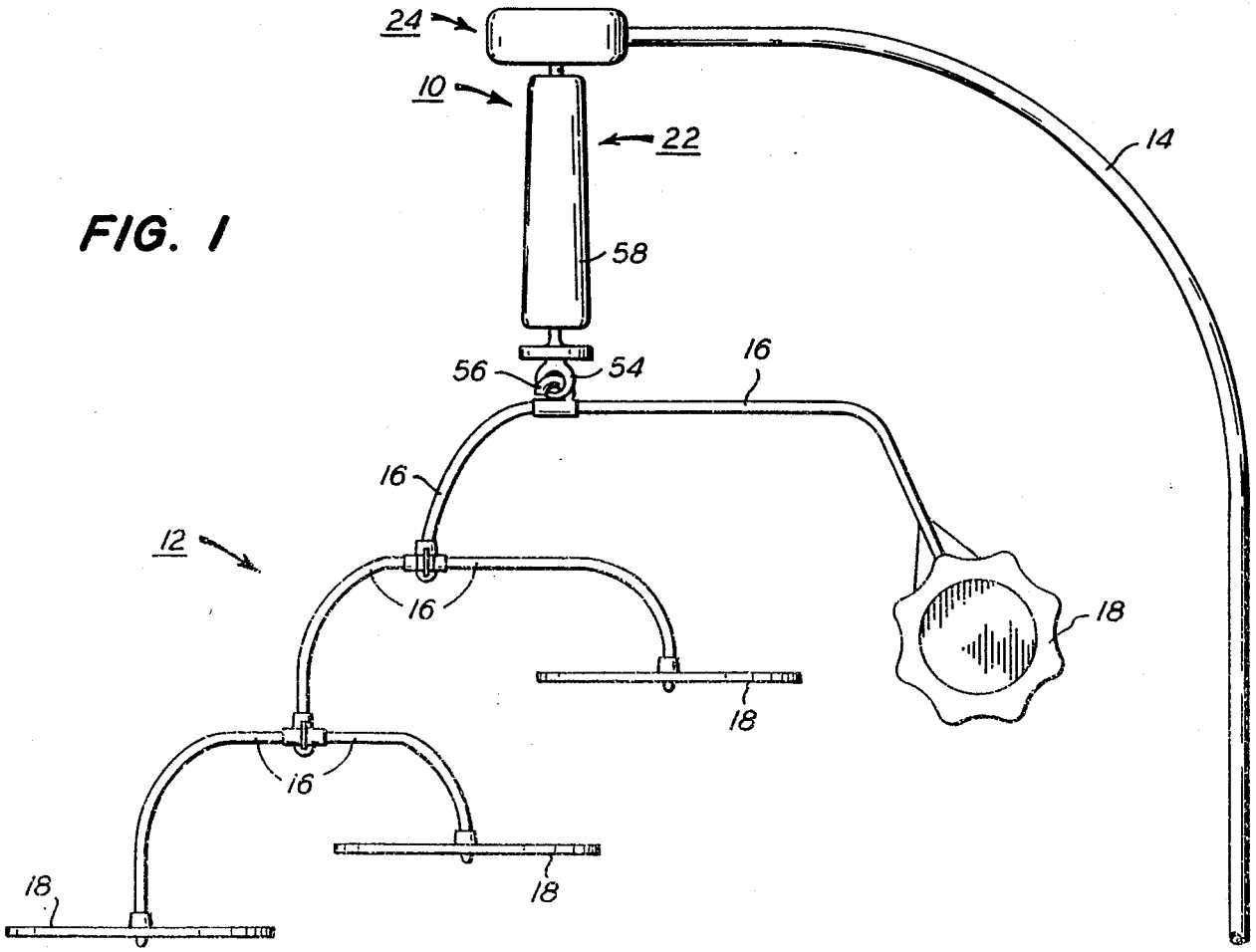
FIG. 1 is a front elevational view of a preferred embodiment of a mounting means for a toy mobile of this invention.

With reference to FIG. 1, a preferred embodiment of a mounting means 10 is disclosed for mounting a toy mobile 12 to mounting arm 14, one end of which is mountable by any suitable clamp, not shown, to a crib, playpen or support surface, not shown. The toy mobile 12 comprises a plurality of connector arms 16, the free ends of which are connected to characters or flat objects 14, such as ornamental animals, flowers, or the like, or to pairs of other connector arms 16, the free ends of which are, in turn, connected to other objects 18 and/or pairs of connector arms 16.

The mounting means 10 for coupling the toy mobile 12 to mounting arm 14 comprises mobile hanger means 22 and retaining means 24 for retaining the hanger means onto the free end of mounting arm 14.

Figure 2:
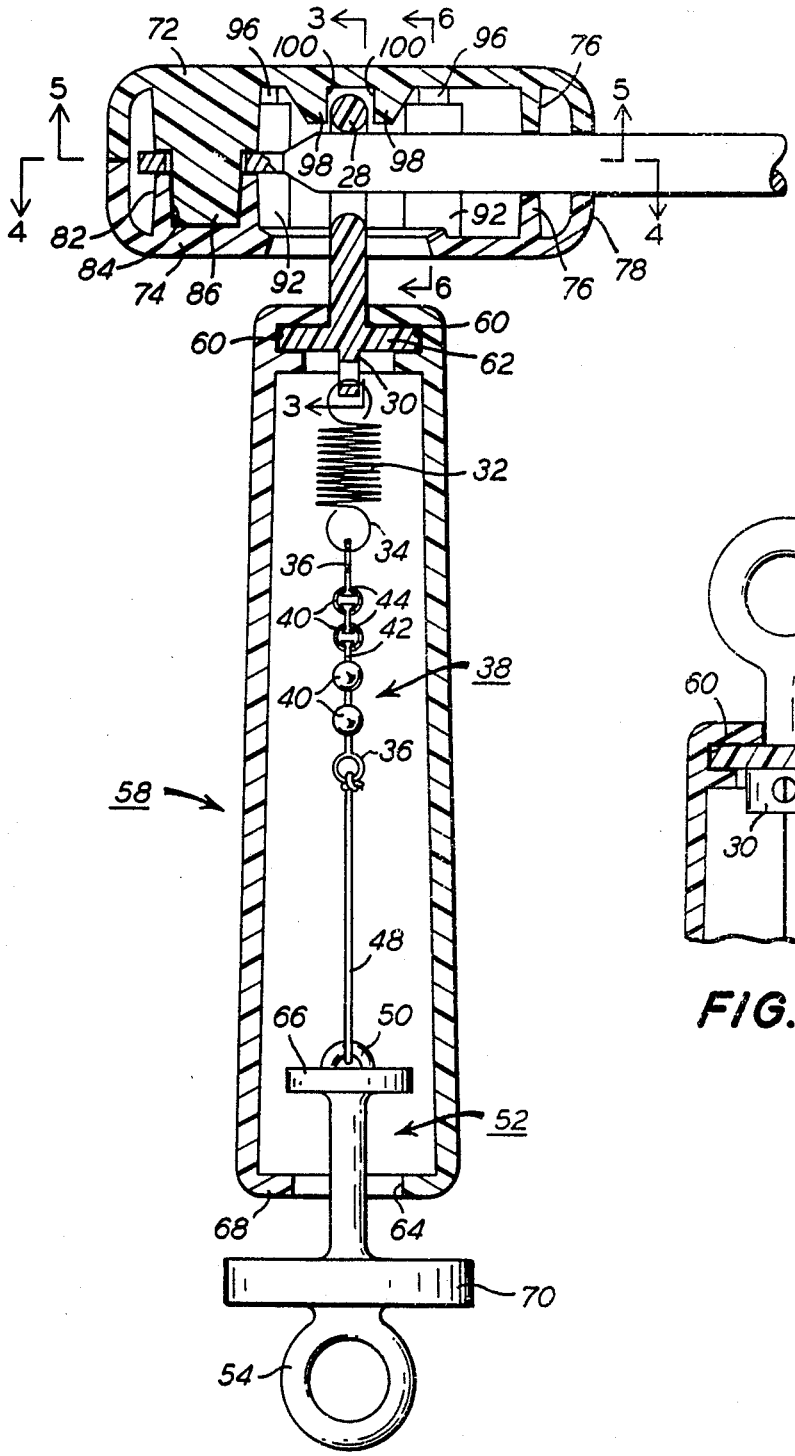
FIG. 2 is an enlarged front elevational view in section of the portion of the mobile of FIG. 1 coupling the mobile to a support arm.
Figure 3:
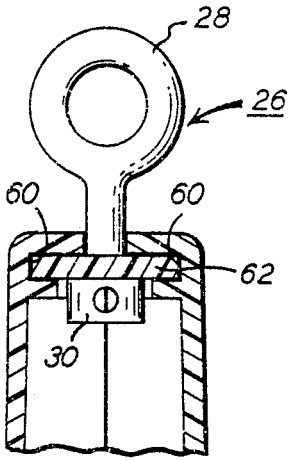
FIG. 3 is a segmental section view taken substantially along line 3—3 of FIG. 2 with the retaining means of the mounting means for retaining the hanger means on the mounting arm omitted for purposes of clarity.

With reference to FIGS. 2 and 3, the hanger means 22 comprises an eyelet member 26 having an eyelet 28 at one end encircling a cylindrical portion of mounting arm 14. The opposite end of eyelet member 26 has a perforated tab 30 to which one end of a helical spring 32 is secured. The opposite end of helical spring 32 has a loop 34 for securing the spring to an eyelet 36 of a bead and chain connector 38 of known type. The bead and chain connector 38 has spherical hollow beads 40 with diametrically opposed openings. The beads 40 are connected to one another by dumbbell shaped links 42 having enlarged ends 44 thereof nesting within the hollow beads. The links 42 at the opposite ends of the chain have eyelets 36, one of which receives looped end 34 of spring 32 as indicated earlier, and the opposite eyelet 36 is secured to a string. The links 42 serve as slip clutches, in which enlarged ends 44 will slip when string 48 is rotatably wound up upon rotation of the mobile 12, thereby preventing the string from overwinding and breaking. The opposite end of string 48 is secured to an eyelet 50 of a stem member 52, the opposite end of which is provided with an eyelet 54 for receiving a hook 56 on mobile 12.

The helical spring 32, bead and chain connector 38, and upper end of stem member 52 are protectively enclosed within a housing 58. The housing comprises mating sections having slots 60 at the upper end for receiving a round or square-shaped flange 62 on eyelet member 26. The mating sections of housing 58 are secured together by any suitable means, not shown. The lower end of the housing has an enlarged opening 64 through which stem member 52 extends. The upper end of stem member 52 has a rim 66 which engages the inner surface of lower end portion 68 of housing 58 to limit how far spring 32 can be extended. The opposite end of stem member 52 has a disk 70 adapted to engage the outer surface of lower end portion 68 of housing 58 upon upward movement of mobile 12 when spring 32 rapidly returns to its original position following extension and release thereof. The disk 70 is further manually engagable for imparting rotatable movement to mobile 12.

Figure 4:
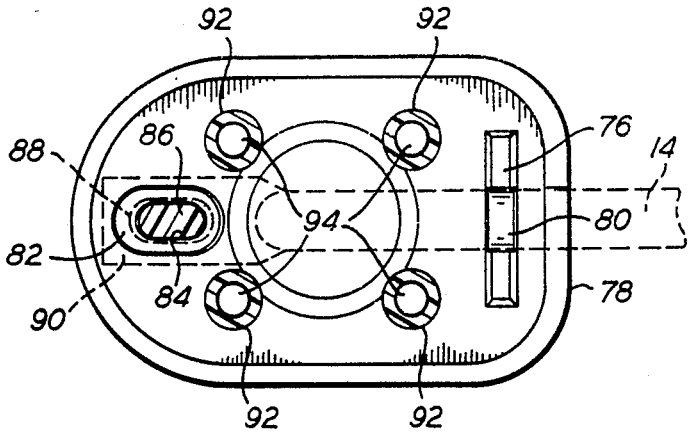
FIG. 4 is a top plan view of the bottom section of a portion of the retaining means taken substantially from line 4—4 of FIG. 2.
Figure 5:
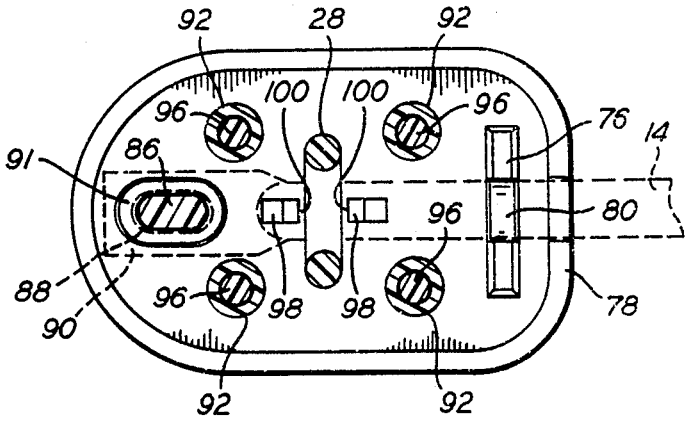
FIG. 5 is a bottom view of the top section of the retaining means referred to in FIG. 4 taken substantially from line 5—5 of FIG. 2.

With reference to FIGS. 2, 4, 5 and 6, retaining means 24 for mounting eyelet member 26 to a cylindrical end portion of mounting arm 14 will now be described. The retaining means 24 comprises upper and lower dish-shaped oblong sections 72, 74 respectively. The lower section 74, as best seen in FIGS. 2 and 4, has a rib 76 and an end wall 78 having semi-cylindrical surfaces 80 for receiving a cylindrical portion of mounting arm 14. The upper section 72 (see Figs. 2 and 5) has mating ribs 76 and walls 78 having similar semi-cylindrical surfaces 80 for enclosing the cylindrical portion of mounting arm 14.

The lower section 74 further has an oblong-shaped boss 82 having a blind oblong-shaped bore 84 for receiving an oblong-shaped post 86 at one end of the upper section, as best seen in FIG. 2. The post 86 extends through an oblong-shaped opening 88 in a flattened end portion 90 of mounting arm 14, which is interposed between boss 82 and a shoulder 91 on post 86 of the upper section.

Figure 6:
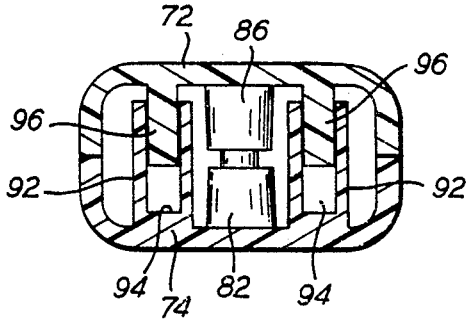
FIG. 6 is a section view taken substantially along line 6—6 of FIG. 2 with the mounting arm and eyelet omitted for purposes of clarity.

The upper and lower sections 72, 74 are guided together, as best seen in FIG. 6, by cylindrical bosses 92 on lower section 74, having blind bores 94 for receiving mating cylindrical posts 96 on upper section 72. The upper section is further provided with spaced ribs 98 (see Figs. 2 and 5) having facing shoulders 100 for capturing eyelet 28 of eyelet member 26 to provide a fixed pivot for the hanger means 22 of mounting means 10. The upper and lower sections 72, 74 are secured together by adhesive or the like.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A mobile comprising a supporting member, a suspended member and mounting means connecting said suspended member to said supporting member, said mounting means comprising:

a housing having first and second generally parallel ends having first and second openings therethrough respectively;

a spring within said housing;

a string having an end within said housing;

slip clutch means interposed between said string end and said spring; and first and second stems coupled to said spring and said string respectively, and extending through said first and second openings and first and second rims on said first and second stems for engaging the first and second ends of the housing for limiting the elongation of said spring and manually engageable disk on one of said stems for imparting rotational movement to wind up said string to wind up said spring.

2. The mounting means of claim 1 wherein said slip clutch means comprises a bead and chain connector.

3. Mounting means for a toy mobile comprising:

a mounting arm having one end securable to a support and an opposite cylindrical free end portion adapted to be arranged in a selected orientation;

an eyelet member having a tab and an eyelet encircling the cylindrical free end portion for allowing the mobile to hang vertically even though the free end of the mounting arm deviates from its selected orientation;

a helical spring connected to the tab for allowing the mobile to be pulled relative to the mounting arm;

a bead and chain connector having one end connected to said spring;

a string having one end connected to the bead and chain connector for allowing rotational movement of the mobile, and a stem member having one end connectable to the mobile and the opposite end connected to the string, and a manually engageable disk on the stem member by which rotatable movement can be imparted to the mobile; and a housing encircling the tab, spring, bead and chain connector, and having a lower end encircling the opposite end of the stem member, and a rim is provided on the opposite end of the stem member which is engageable with the inner surface of the lower end of the housing to limit the distance the mobile can be pulled in one direction tensioning the spring, and the disk is engageable with the lower end of the housing to limit the distance the mobile can be pulled by the tensioned spring in the opposite direction when the mobile is released.

* * * * *